US011098706B2

(12) United States Patent
Gelbert

(10) Patent No.: US 11,098,706 B2
(45) Date of Patent: Aug. 24, 2021

(54) HOSE CARTRIDGE FOR A PERISTALTIC PUMP HAVING ELASTIC LEGS

(71) Applicant: W.O.M. World of Medicine GmbH, Berlin (DE)

(72) Inventor: Nils Gelbert, Berlin (DE)

(73) Assignee: W.O.M. World of Medicine GmbH, Berlin (DE)

( * ) Notice: Subject to any disclaimer, the term of this patent is extended or adjusted under 35 U.S.C. 154(b) by 154 days.

(21) Appl. No.: 15/752,092

(22) PCT Filed: Jul. 27, 2017

(86) PCT No.: PCT/DE2017/000226

§ 371 (c)(1),
(2) Date: Feb. 12, 2018

(87) PCT Pub. No.: WO2018/019320

PCT Pub. Date: Feb. 1, 2018

(65) Prior Publication Data

US 2018/0238318 A1 Aug. 23, 2018

(30) Foreign Application Priority Data

Jul. 29, 2016 (DE) ..... 102016009174.6

(51) Int. Cl.
*F04B 43/12* (2006.01)
*F04B 53/16* (2006.01)

(52) U.S. Cl.
CPC ..... *F04B 43/1253* (2013.01); *F04B 53/16* (2013.01)

(58) Field of Classification Search
CPC ..... F04B 53/16; F04B 53/22; F04B 43/1253; F04B 43/086; F04B 43/1292; F04B 43/08; F04B 43/084; B29C 45/0001; B29C 45/0081; A61M 2207/00; A61M 16/525; A61M 16/5253; A61M 403/45
USPC ..... 417/477.2; 264/295, 328.1; 29/888.02, 29/888.022
See application file for complete search history.

(56) References Cited

U.S. PATENT DOCUMENTS 5,257,917 A * 11/1993 Minarik ..... F04B 43/1292 417/475
5,403,277 A * 4/1995 Dodge ..... F04B 43/1253 604/30
5,533,877 A * 7/1996 Friedmann ..... F04B 43/0072 417/477.1
9,289,110 B2 3/2016 Woolford
(Continued)

FOREIGN PATENT DOCUMENTS

DE 102 44 090 A1 4/2004
EP 1 108 891 A2 6/2001
(Continued)

*Primary Examiner* — Philip E Stimpert
(74) *Attorney, Agent, or Firm* — Mayer & Williams, PC; Stuart H. Mayer

(57) ABSTRACT

The present invention relates to an improvement of a hose cassette for a peristaltic pump. The hose cassette has a U-shape and is made from a flexible material, so that the liquid-conveying hose segment can surround the roller wheel in a better way, whereby the pumping capacity is improved. Surprisingly, a cassette configured in such a way can in an easier and more economical manner be made than cassettes of the prior art.

12 Claims, 8 Drawing Sheets

(56) References Cited

U.S. PATENT DOCUMENTS

| | | | | |
|---|---|---|---|---|
| 2007/0104599 | A1* | 5/2007 | Michels | F04B 43/1292<br>417/477.1 |
| 2008/0110694 | A1* | 5/2008 | Niezur | B62D 29/002<br>181/264 |

FOREIGN PATENT DOCUMENTS

| | | | | |
|---|---|---|---|---|
| EP | 1 820 967 | A1 | 8/2007 | |
| EP | 1820967 | A1 * | 8/2007 | F04B 43/1238 |

* cited by examiner

HOSE CARTRIDGE FOR A PERISTALTIC PUMP HAVING ELASTIC LEGS

BACKGROUND OF THE INVENTION

The present invention relates to an improvement of a hose cassette for a peristaltic pump. The hose cassette has a U-shape and is made from a flexible material, so that the liquid-conveying hose segment can surround the roller wheel in a better way, whereby the pumping capacity is improved. Surprisingly, a cassette configured in such a way can in an easier and more economical manner be made than cassettes of the prior art.

In medical engineering, frequently peristaltic hose pumps are employed as suction and rinse pumps, in particular in minimally invasive surgery. Such pumps are frequently used in arthroscopy, laparoscopy, urology, and hysteroscopy. In such applications, of course, securing biocompatibility and sterility is particularly important. Further, the suitability in daily operation is also important: In particular the set-up time is essential, i.e. the time that the medical staff needs for preparing a liquid pump prior to use.

For simplifying the handling of such peristaltic pumps, the use of pre-arranged hose cassettes is established. Such hose cassettes are, for instance, described in the documents EP 1 108 891 A2, U.S. Pat. No. 9,289,110 B2, or EP 1 820 967 A1. The EP 1 820 967 A1 describes, for instance, a hose cassette with a cassette housing with two front-side fixing elements, with a pump hose segment extending between the two fixing elements, which pump hose segment, by insertion of the cassette into the pump, spans around the roller wheel. The cassette already includes all hose connections. It can simply be slid into the opening of the hose pump and is thus immediately ready for use.

For different medical purpose, it would be desirable that the pumping capacity of such a pump can further be improved. Since the hose cassettes are employed as disposable units, a reduction of the manufacturing cost would also be desirable.

Surprisingly, it has been found that by the improved hose cassette described in the following, an improved pumping capacity can be achieved, and that the described hose cassette can be manufactured at lower cost.

SUMMARY OF THE INVENTION

The subject matter of the invention is, therefore, a hose cassette with a U-shaped configuration,
having a base surface and two legs,
the legs being made from a tough, flexible material, preferably from a thermoplastic material,
at the end of the base surface of the legs, one fixing element each being stationarily fixed,
at least one pump hose segment extending between the fixing elements, with the hose cassette not being inserted into the pump, along a circular segment spanning an angle of at least 120 degrees,
wherein one fixing element further includes at least one hose as an inlet and the second fixing element further includes at least one hose as an outlet, the legs being connected to each other at the base surface only and being reversibly deformable by spreading, so that the distance between the fixing elements can reversibly be modified during the insertion of the hose cassette into the roller wheel pump.

DETAILED DESCRIPTION OF THE INVENTION

Preferred embodiments are subject matter of the subclaims.

Figure 4:
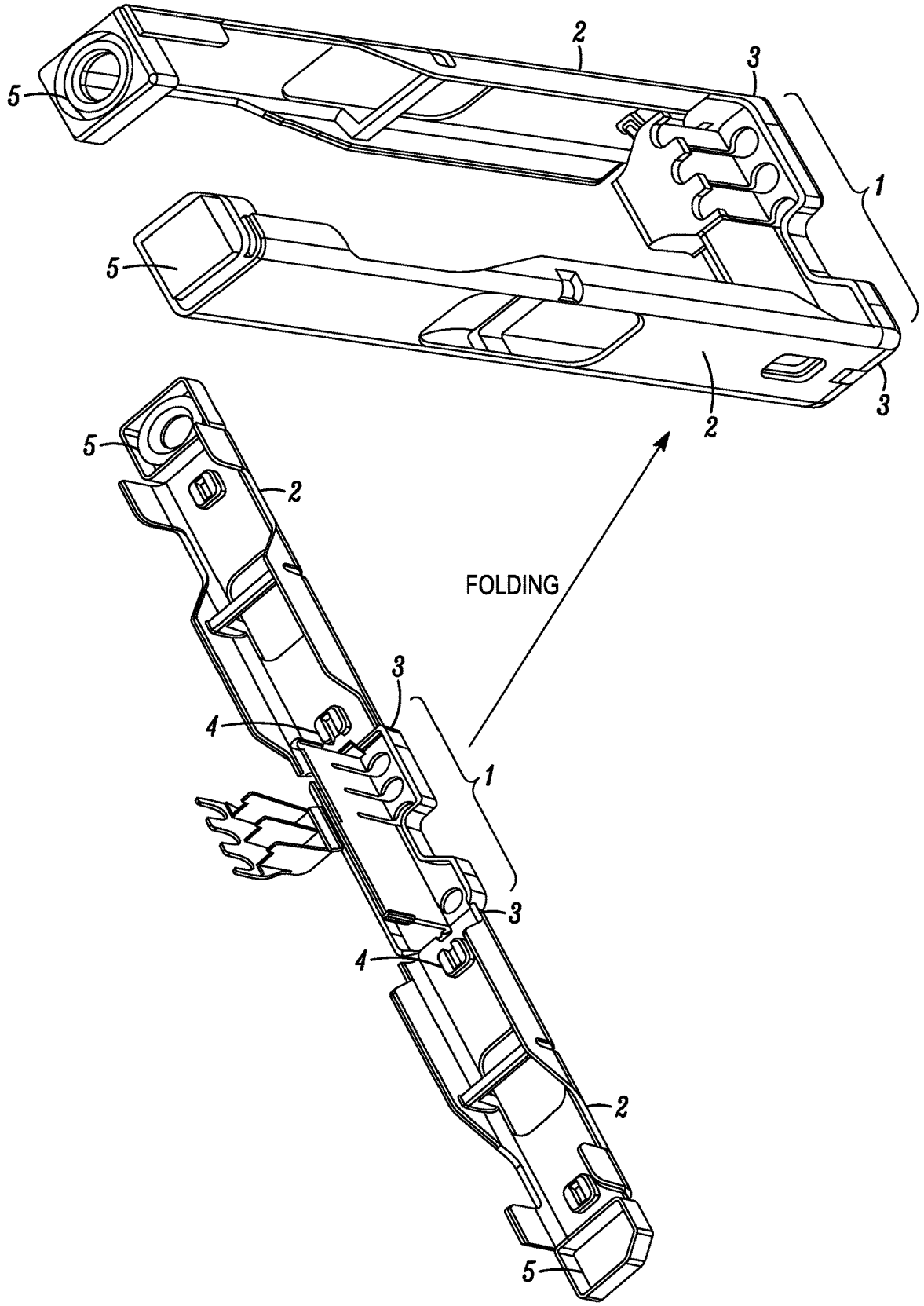
FIG. 4 shows a specific embodiment of the host cassette.

FIG. 4 shows an embodiment of the host cassette. The hose cassette includes a base surface (1) and two legs (2), the two legs (2) connected to the base-surface (1) by hinges (3). Fixing elements (5) are provided at the end of the legs (2). Latching elements (4) are provided for snap-fitting the legs to the base portion when folded.

Figure 1:
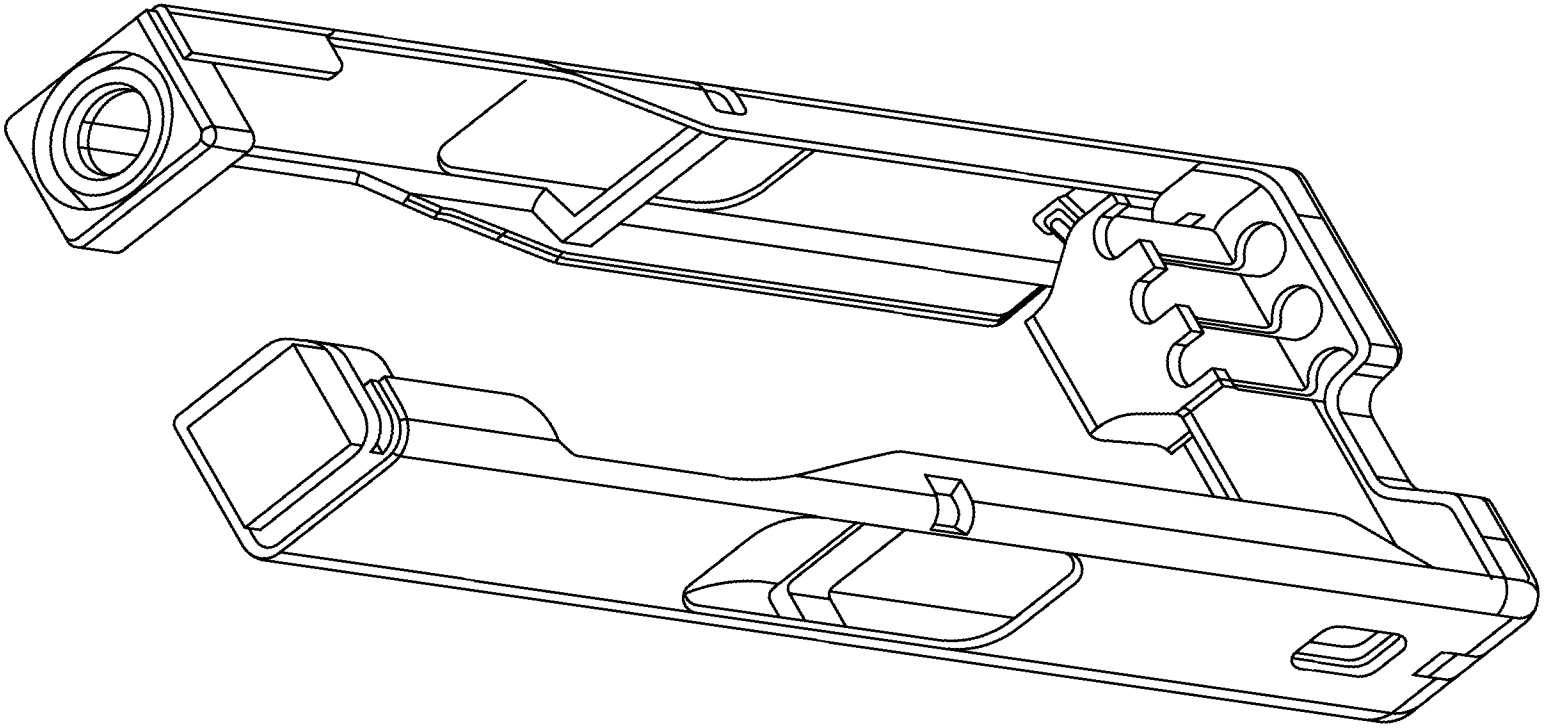
FIG. 1 shows a cassette with the two legs connected to each other at the base surface only.
Figure 2A:
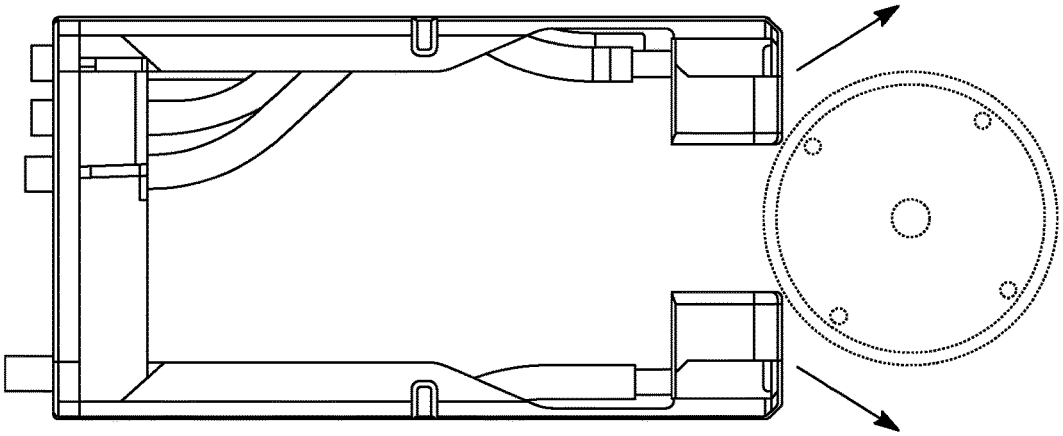
FIGS. 2A, 2B and 2C show how the legs spread during insertion, and how the legs return to the original distance in the operating position of the cassette.
Figure 2B:
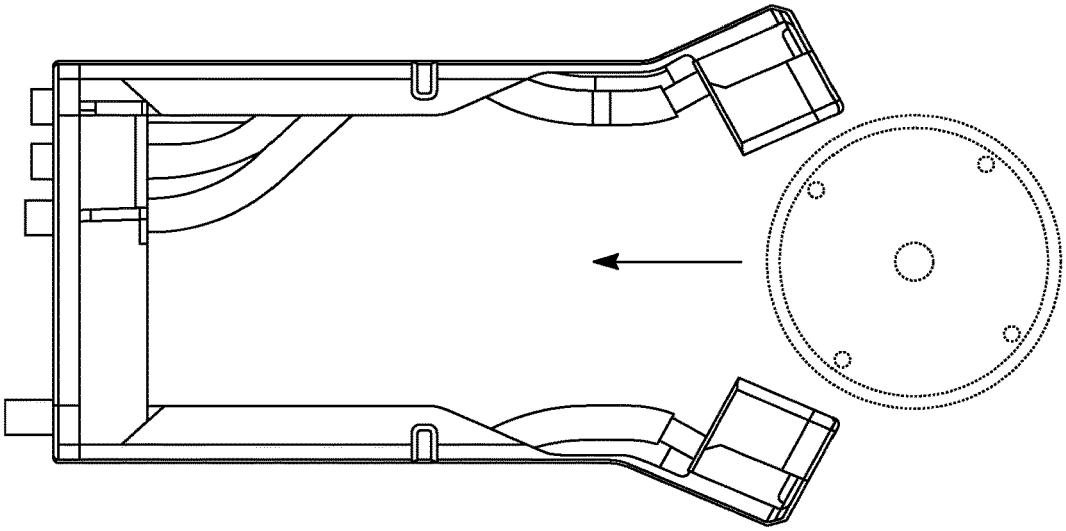
Figure 2C:
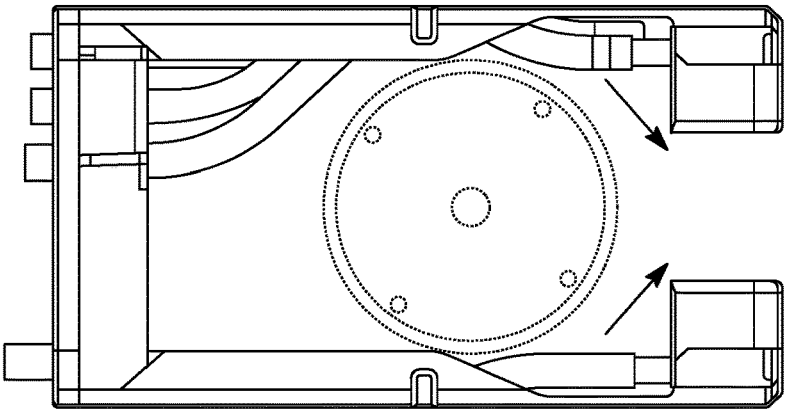

The special feature of the cassette according to the invention, compared to prior art cassettes, is that the two legs are connected to each other at the base surface only (FIG. 1). In this way, the legs can be moved away from each other by spreading them open. This possibility of spreading-open facilitates the insertion of the cassette frame into the pump, specifically: the fitting around the roller wheel. In the prior art hose cassettes, the ends of the legs (e.g., the fixing elements of the hose cassette according to EP 1 820 967 A1) need to have a clearance from each other that is larger than the diameter of the roller wheel (see FIG. 4 of EP 1 820 967 A1). In the hose cassette according to the invention, the legs can be spread during insertion, and in the operating position of the cassette they will return to the original distance (FIG. 2). As a result, it is achieved that the distance of the two fixing elements at the ends of the legs may be smaller, in the operating position, than the diameter of the roller wheel. The distance of the two fixing elements from each other is usually increased by more than 40%, preferably by more than 80%.

Figure 3A:
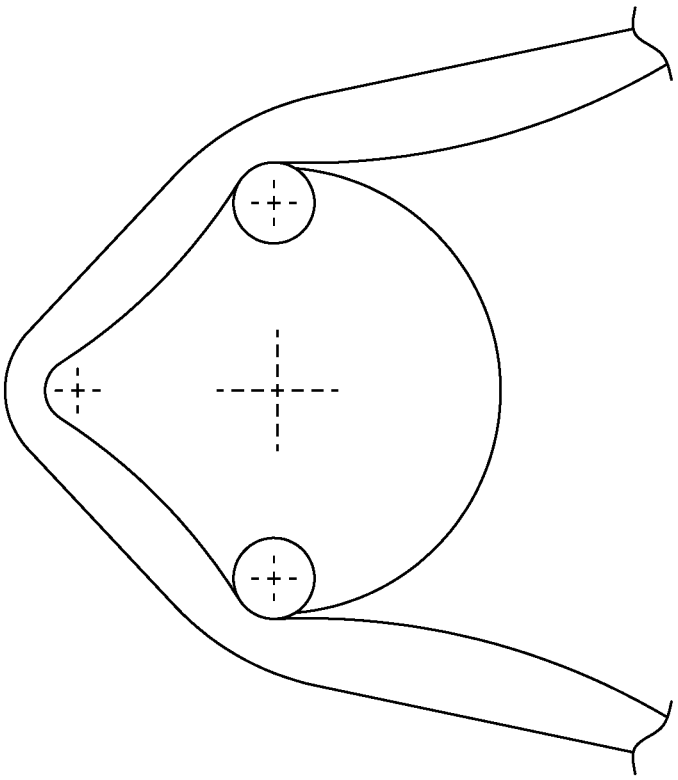
FIG. 3A shows a roller wheel pump as described in the prior art. One point of the hose is closed by one of the roller wheels.
Figure 3B:
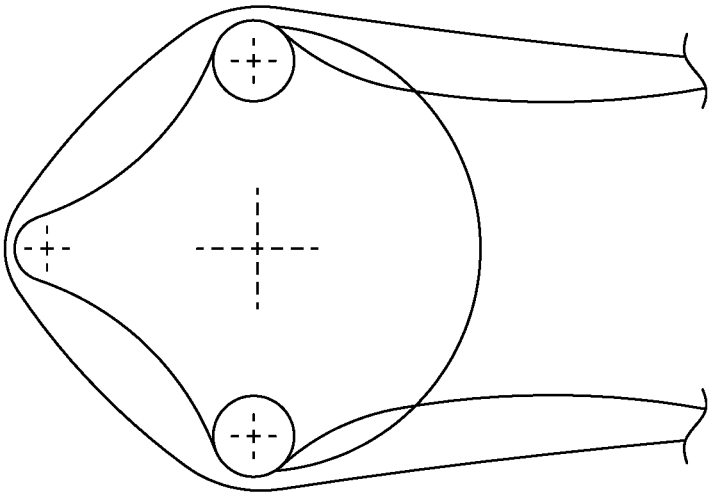
FIG. 3B shows the roller wheel pump according to the invention. Three points of the hose are completely closed by three of the four roller wheels).

As has been found out, such a configuration in the operating position (clearance of the fixing elements smaller than the diameter of the roller wheel) is advantageous for the pumping capacity: In the roller wheel pump according to the invention, in the illustrated operating position, the hose is closed at three points (namely the three roller wheels), so that no liquid flow is possible against the movement of the roller wheel (FIG. 3 bottom). In the prior art configuration, maximum one point of the hose is completely closed (FIG. 3 top). As a result, the cassette according to the invention has a higher pumping capacity and in particular a larger resistance against a counter-pressure (e.g., in case of a liquid blocking). At the same time, the risk of cross-contamination by a return flow of the liquid due to the counter-pressure is minimized.

For the hose cassette according to the invention, which basically only consists of a U-shaped hose cassette frame, less material is required than for a classic cassette, as it is illustrated, for instance, in EP 1 820 967. The hose cassette frame according to the invention only consists of the base surface and the two legs. The cassette is made from a tough, flexible material, preferably from a thermoplastic material, such as PVC, SBC, PA, PLA, ABS, MABS, PP, PS, PTFE, PET, PE, or mixtures of the above. It is crucial that the legs are deformable (e.g., spreadable), which is secured by the selection of the material and the precise shaping.

The fixing elements provided at the ends of the U-shaped cassette are typically configured as hollow bodies that permit the connection of hoses by means of corresponding connection pieces. At each fixing element is provided, for instance, an inlet or outlet hose, respectively. Between the fixing elements, the pump hose segment is located. Typically, the inlet and outlet hoses are made from a material different from that of the pump hose segment. For instance, the pump hose segment may consist of a highly flexible silicone, whereas the inlet and outlet hoses may be made from a relatively low-cost PVC.

Furthermore, the sensors or membranes described below may be part of the fixing elements. Such fixing elements are described, for instance, in EP 1 820 967, which is incorporated here by reference in its entirety. In the simplest case, the fixing elements fix one hose only, so that between the ends of the legs with the fixing elements the pump hose segment is formed. In this way, they provide for the tension of the pump hose element in the operating position of the cassette and for the necessary reversal of the flow direction of the liquid flow.

Figure 6B:
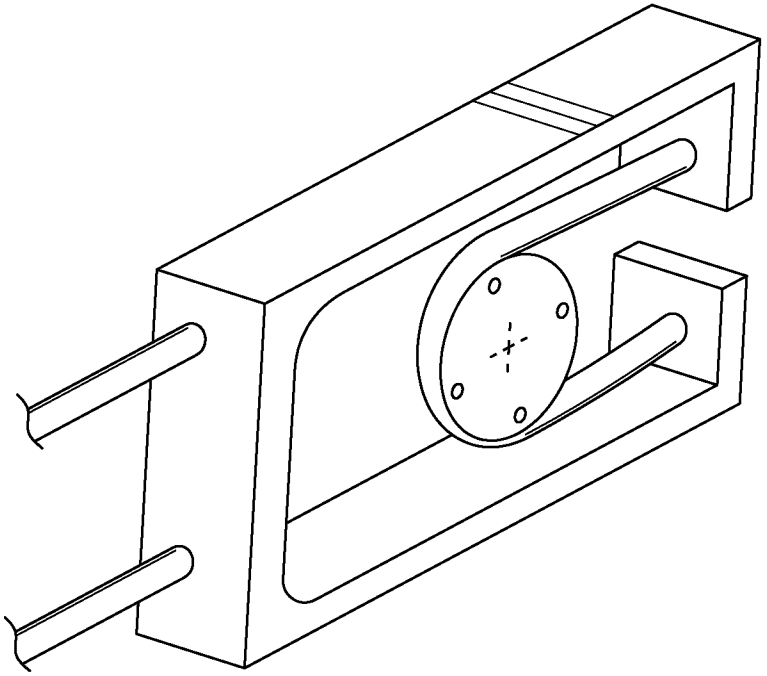
FIG. 6A and FIG. 6B show a cassette with legs deformed by bending out of the plane of the roller wheel.
Figure 6A:
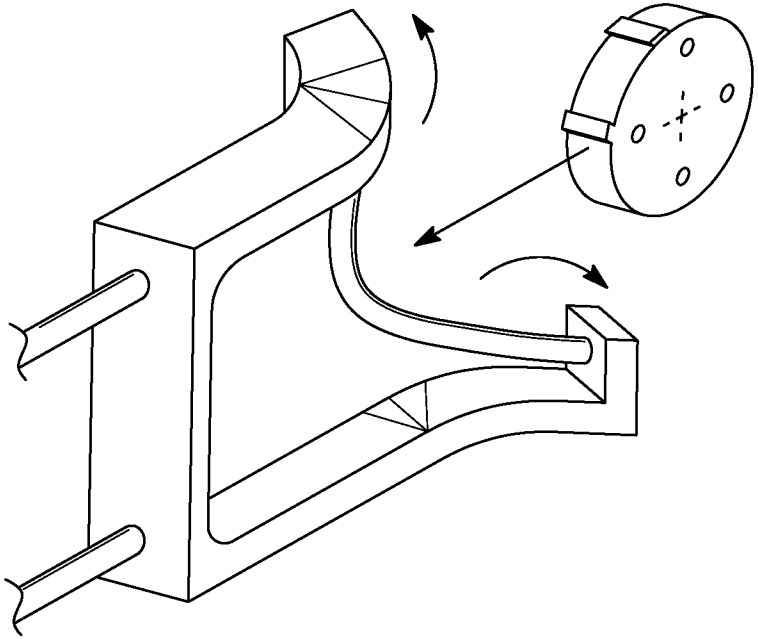

For the operation at the roller wheel pump with a roller wheel diameter of 8 cm, the inner distance of the fixing elements may be, for instance, 5-8 cm. By spreading the legs, they can be guided around the roller wheel. Alternatively to spreading, the legs may also be deformed by bending out of the plane of the roller wheel, as is illustrated in FIG. 6. In this case, the legs must have a corresponding deformability.

The pump hose segment extending between the fixing elements extends along a circular segment and spans an angle of at least 120 degrees, preferably at least 150 degrees, particularly preferably approx. 180 degrees. In special cases, the angle may also exceed 180 degrees, e.g., when the fixing elements are pressed together, in the operating position, by corresponding guide elements of the pump.

The simplified shape of the cassette also permits, surprisingly, a particularly simple manufacture:

The whole cassette can be manufactured in a single operation as a flat injection-molded part. The injection-molded part includes at least two locations, where the material is configured as a film hinge, so that it can be folded without breaking, in order to obtain the U-shape ("folding cassette", see FIG. 4). Further, the injection-molded part includes latching devices that permit snap-fitting of parts of the cassette folded toward each other into a ready-to-use condition. If applicable, additional adhesive or welding operations can be performed in the region of the folding locations, in order to increase stability. Preferably, the manufactured injection-molded part already includes corresponding holes and recesses as well as guide webs for the hoses. If necessary, an increase of stiffness can be provided by corresponding molded elements (e.g., ribs).

During manufacturing, the fixing elements can be fitted by means of injection molding or 3-D printing. Alternatively, they are manufactured in a separate operation and fitted onto the ends of the legs. Alternatively, the folding cassette can, of course, also be manufactured by 3-D printing.

Figure 8A:
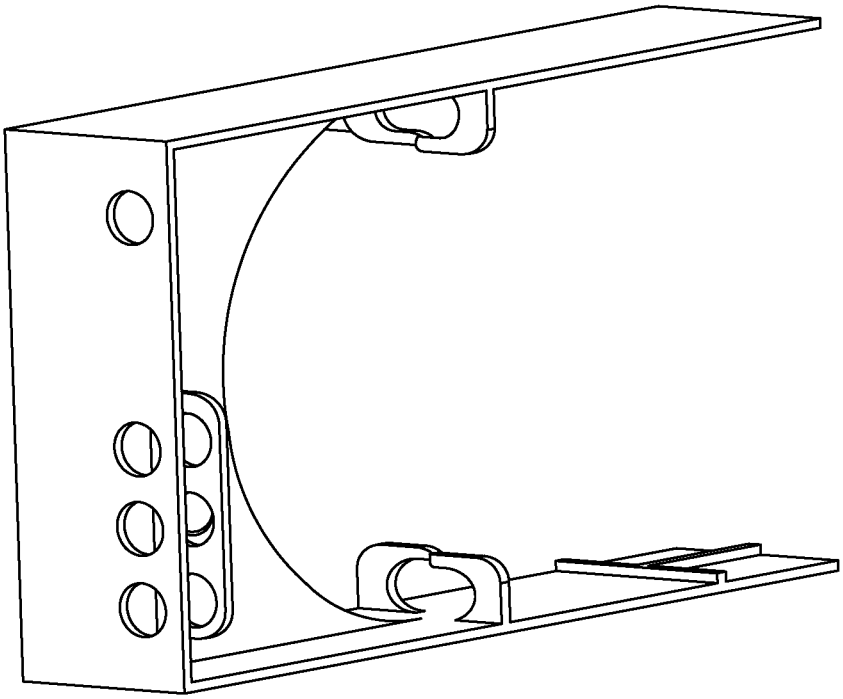
FIGS 8A and 8B shows a specific embodiment of the host cassette as one piece.
Figure 8B:
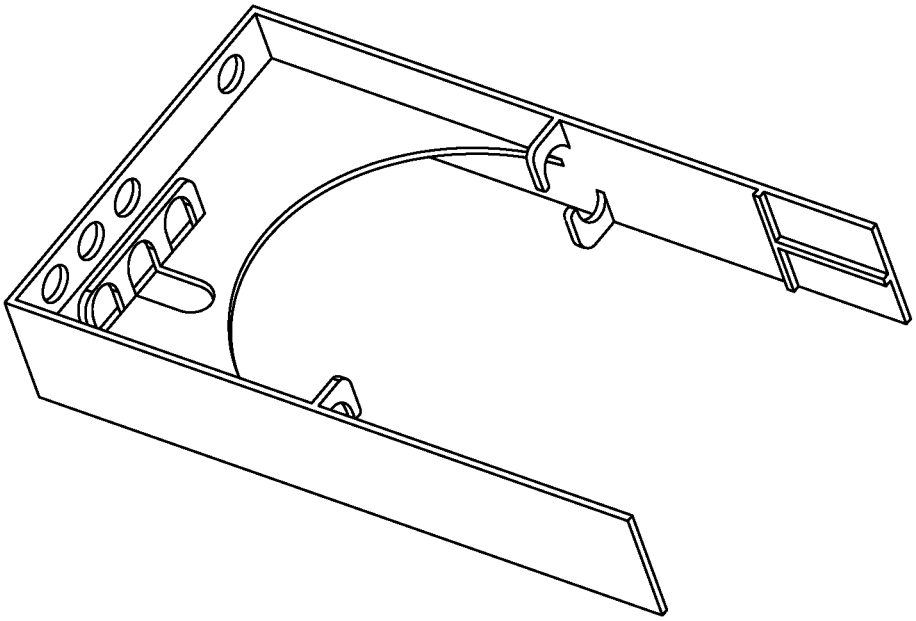

Further alternatively, the cassette can, of course, also be molded or printed in a classic way as one piece (see FIG. 8) or as multiple pieces.

Through one or more holes in the base portion of the cassette, inlet hoses can be introduced and connected to the fixing element. The same applies to the outlet hoses.

In a particular embodiment of the cassette, at least one front side of the fixing element includes a flexible membrane (e.g., made from silicone, TPE, or PVC). With inserted cassette, the latter can interact with a matching force/travel transducer and thus permit a pressure measurement.

In particular embodiments of the hose cassette, the hose legs may comprise intentionally breakable areas, so that a multiple use is not possible.

In particular embodiments of the invention, the cassette comprises information that can be read by the pump. This is information, for instance, about intended use, capacity, or expiration date. The corresponding data may be stored on data carriers, e.g., in the form of a bar code, but also, for instance, by an RFID chip or in another known manner. Depending on the type of storage, reading of the information occurs by radio waves or light.

In particular embodiments of the invention, the cassette comprises a code, in order to prevent multiple use. This code can be stored electronically, but can also be implemented by color or shape measures.

Improvements of the cassettes according to the invention may also include a plurality of hose segments in parallel, so that a plurality of hose lines can simultaneously be pumped. So, e.g., the inlet into and the outlet out of a body cavity can be achieved simultaneously by means of a pump and of a cassette according to the invention.

The hose cassette, in particular the fixing elements may also comprise further sensors. For instance, a temperature measurement of the pumped liquid may occur by a corresponding temperature sensor. By measurement of the electrical resistance or of the conductivity, the type of the liquid and its content of dissolved substances (e.g., salts or sorbitol/mannitol) can be measured. Furthermore, there exists the possibility of a measurement of air bubbles, so that corresponding warnings are possible. The measurement of the oxygen ($O_2$) or carbon dioxide ($CO_2$) content and/or other parameters is possible by means of corresponding sensors. Preferably, the sensors are as far as possible part of the pump: Thus, for instance, the temperature measurement can be made by an infrared sensor in the pump, provided that the hose cassette includes an IR-transparent viewing window. For the measurement of the resistance or conductivity, the cassette may include two electrodes with corresponding connections. By corresponding contacts at the pump, the electrical parameters can then be measured.

The hose cassette according to the invention can be used for sucking-off liquids (water, fat, blood, etc.), but also for rinsing body cavities, e.g., in the field of endoscopy. By the increased pumping capacity and counter-pressure resistance, compared to classic roller wheel pumps, an improvement of the widening of body cavities in the context of surgical interventions is obtained. The hose cassette according to the invention can also be employed in wound therapy for cleaning wounds. Further, the cassette can be used in the context of blood circulation (e.g., during dialysis, blood heating or oxygen enrichment).

The roller wheel pump required for the operation of the hose cassette may substantially be designed as described in EP 1 820 967. The pump comprises, for instance, in its housing a cassette shaft being complementary to the cassette. Helpful are, herein, guide elements, in particular guide rails that cause, when inserting the cassette, first the required spreading of the legs and then the return into the non-spread condition. Latching elements facilitate the support of the cassette in the operating position. Of course, the sensor elements (e.g., the pressure sensor) must be positioned at the location, where in the operating position the fixing elements are located. The insertion opening of the housing for the cassette may have a coded shape, in order to prevent errors when inserting the cassette.

The basic idea according to the invention can also be achieved by alternative embodiments.

Figure 7A:
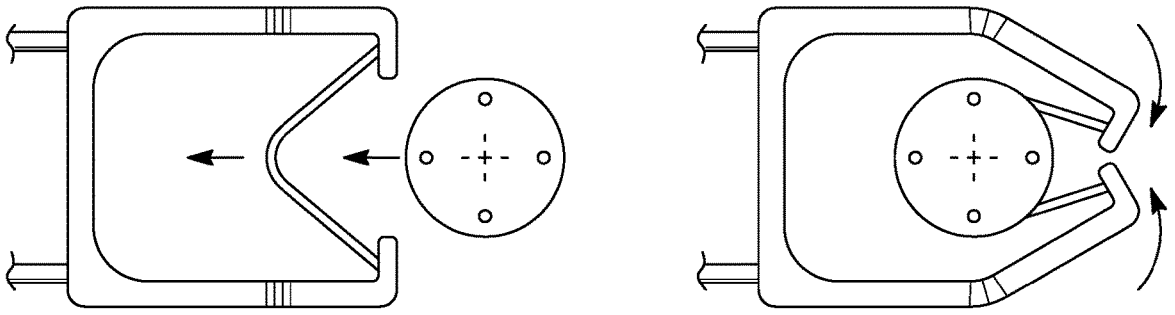
FIG. 7*a* shows an alternative embodiment of the invention.

FIG. 7*a* shows, for instance, an alternative embodiment, in which the cassette legs need not be spread open, in order to surround the roller wheel in an optimum manner. In the embodiment according to 7a, the legs include joint-like portions, so that the ends of the legs can be deformed inwardly. By the tension of the pump hose segment, the ends of the legs with the fixing elements will deform inwardly and provide for the necessary enclosure of the roller wheel.

Figure 7B:
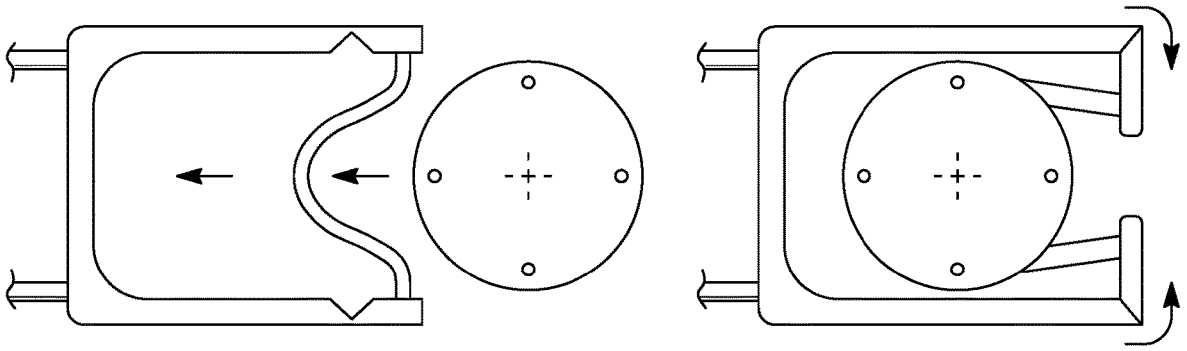
FIG. 7*b* shows a similar design as Fig. 7A with a hinge-like intentional deformable area of the ends of the legs.

FIG. 7*b* shows a similar design with a hinge-like intentional deformable area of the ends of the legs.

Figure 7C:
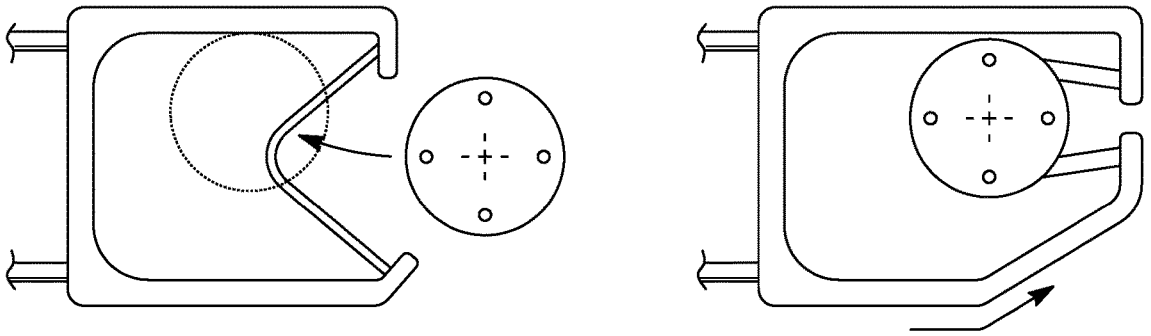
FIG. 7*c* shows a further alternative embodiment of the invention with asymmetrical legs (deformation of one leg only)

As schematically illustrated in FIG. 7*c*, it is in some circumstances possible to have only one deformable leg, e.g., for an eccentric position of the roller wheel within the cassette (in the operating position).

In these embodiments, the distance of the two fixing elements from each other is usually reduced by more than 30%, preferably by more than 60%, in particular by more than 80%.

EXAMPLE

Figure 5:
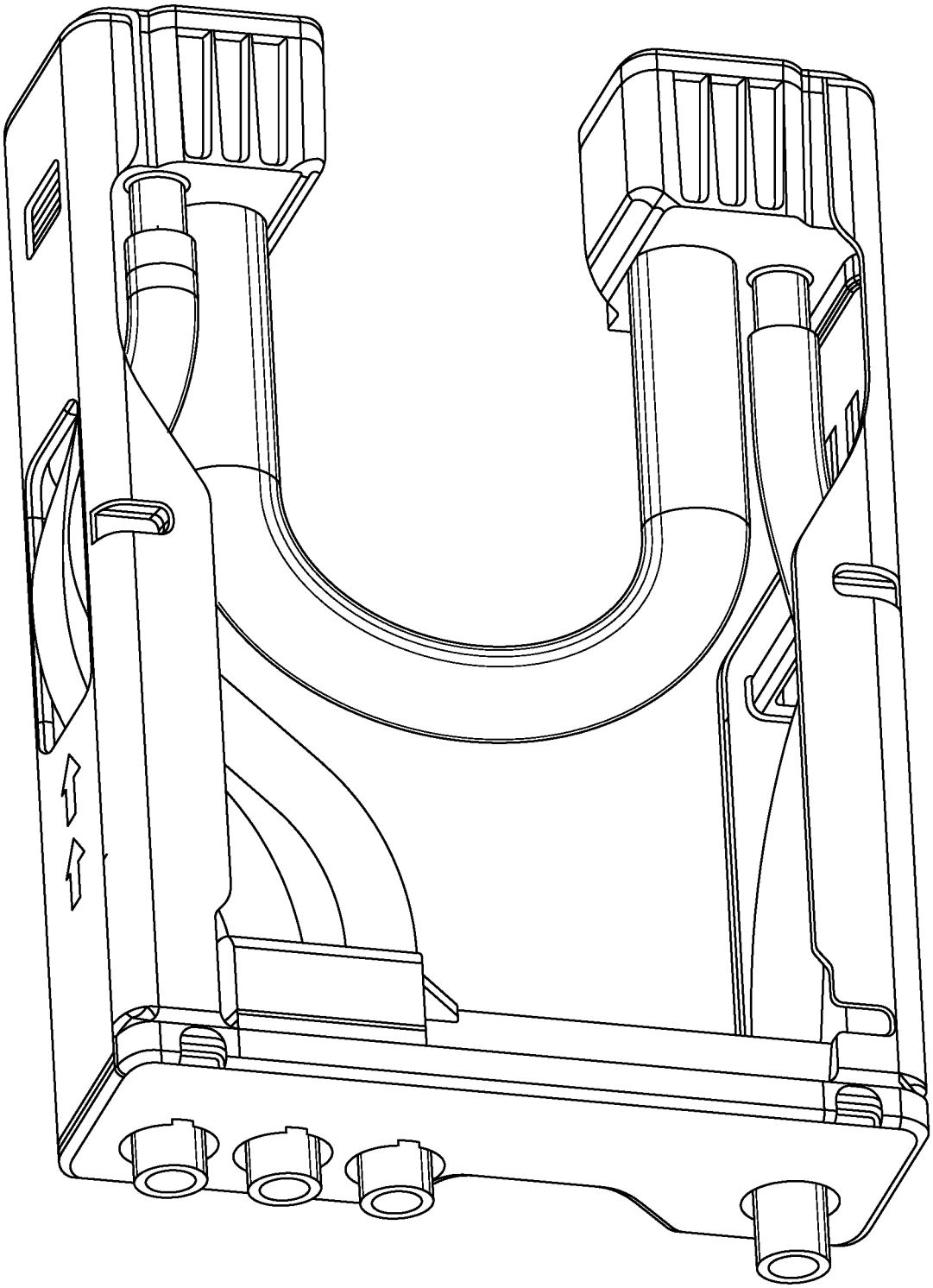
FIG. 5 shows an alternative embodiment of the host cassette.

An embodiment of a cassette according to the invention is for instance illustrated in FIG. 5:

A folded cassette with the outside dimensions 146×86×30 mm, consisting of the thermoplastic material SBC (Styrolux 656c, elastic modulus=1,800 MPa, elongation at break 20%) with a wall thickness of 1.5 mm. In the non-loaded state, the mean distance between the ends of the pump segment is A1=50 mm. The pump segment is a silicone hose with hardness 50 Shore A, length=160 mm, outside diameter=11 mm and inside diameter=8 mm. The clearance of the cassette ends is A3=32 mm.

When the cassette is inserted into the pump, it is required to overcome the roller wheel with a diameter of 60 mm and a thickness of 24 mm. The elasticity of the material and the particular geometry of the cassette enable a spreading of the cassette dimension A3 by more than 87%. Behind the roller wheel, the elastically deformed cassette returns into its original shape (A3=32 mm, A1=50 mm).

In order to generate a high pump capacity and to secure the self-sealing effect between roller wheel and pump segment, the pump segment needs to be sufficiently tensioned, and the ends of the pump segment need to have a distance smaller than the roller wheel diameter. For this purpose, the cassette is further slid relative to the roller wheel along the distance A2, until the axis of the roller wheel with the diameter of 60 mm is at point P1. In the tensioned end position, the distance between cassette and roller wheel axis is A2=47.5 mm. The pump segment is thus expanded by approx. 25% of its length. Further, the ends of the cassette are supported, in order to fix the dimension A3=32 mm. Thereby, the mean distance of the ends of the pump segment A1=50 mm remains permanently smaller than the roller wheel diameter of 60 mm (here by about 17% smaller).

The invention claimed is:

1. A hose cassette with a U-shaped configuration for use in a roller wheel pump, having a base surface and two legs, the legs each being connected to the base surface by a film hinge and the U-shaped configuration being formed by snap-fitting the legs at latching elements of the base surface, at the end of the legs, one fixing element each being stationarily fixed, at least one inlet hose extending toward the first fixing element, at least one outlet hose extending away from the second fixing element, at least one pump hose segment extending between the fixing elements, with the hose cassette not being inserted into the pump, along a circular segment spanning an angle of at least 120 degrees, wherein the legs are connected to each other at the base surface only and are reversibly deformable by spreading, so that the distance between the fixing elements can reversibly be modified during the insertion of the hose cassette into the roller wheel pump, wherein a distance between the first and second fixing elements is smaller when in an operating position than a diameter of a roller wheel of the roller wheel pump.

2. The hose cassette according to claim 1, wherein the cassette is made from a thermoplastic material.

3. The hose cassette according to claim 1, wherein that the legs are configured to be, by bending, at least one of:

a) reversibly spread open, b) reversibly pressed together, or c) reversibly deformed out of the plane of the roller wheel.

4. The hose cassette according to claim 1, wherein at least one sensor is provided for measuring at least one parameter of a pumped liquid.

5. The hose cassette according to claim 4, wherein the at least one parameter is at least one of pressure, temperature, liquid flow, resistance, conductivity, O2 content, CO2 content, salt content, and/or gas bubbles.

6. The hose cassette according to claim 1, wherein the fixing element of at least one of the two legs includes a flexible membrane for pressure measurement.

7. The hose cassette according to claim 1, wherein in or on the cassette, information is stored on data carriers.

8. The hose cassette according to claim 1, wherein the legs are made from a thermoplastic material.

9. The hose a cassette of claim 2 wherein the cassette is made from a material selected from the group consisting of PVC, SBC, PA, PC, PLA, ABS, MABS, PP, PS, PTFE, PET, PE, or mixtures of the above.

10. A method of manufacturing a hose cassette with a U-shaped configuration, having a base surface and two legs, at the end of the legs, one fixing element each being stationarily fixed, at least one inlet hose extending toward a first of the fixing elements, at least one outlet hose extending away from a second of the fixing elements, at least one pump hose segment extending between the fixing elements, with the hose cassette not being inserted into the pump, along a circular segment spanning at least an angle of 120 degrees, the legs being connected to each other at the base surface only and being reversibly deformable by spreading, so that the distance between the fixing elements is reversibly enlargable during the insertion of the hose cassette into a roller wheel pump, wherein a distance between the first and second fixing elements is smaller when in an operating position than a diameter of a roller wheel of the roller wheel pump comprising the following steps:

a) making a substantially flat injection-molded part including the base surface and the two legs, with at least two film hinges and a plurality of latching elements, b) folding the injection-molded part at the film hinges, c) snap-fitting the legs at the latching elements of the base portion, d) mounting two the first and second fixing elements, e) fitting the inlet and outlet hoses at their respective elements.

11. The method of claim 10 wherein the substantially flat injection-molded part is made from a thermoplastic material.

12. The method according to claim 11, wherein the thermoplastic material is PVC, SBC, PA, PC, PLA, ABS, MABS, PP, PS, PTFE, PET, PE, or mixtures of the above.

* * * * *